US010827866B2

(12) United States Patent
Prest

(10) Patent No.: US 10,827,866 B2
(45) Date of Patent: Nov. 10, 2020

(54) RUG MOUNTING SYSTEMS AND METHOD

(71) Applicant: PREST-O-FIT MANUFACTURING, INC., Chandler, AZ (US)

(72) Inventor: J. David Prest, Tempe, AZ (US)

(73) Assignee: PREST-O-FIT MANUFACTURING, INC., Chandler, AZ (US)

( * ) Notice: Subject to any disclaimer, the term of this patent is extended or adjusted under 35 U.S.C. 154(b) by 0 days.

(21) Appl. No.: 16/135,461

(22) Filed: Sep. 19, 2018

(65) Prior Publication Data

US 2019/0082873 A1 Mar. 21, 2019

Related U.S. Application Data

(60) Provisional application No. 62/560,468, filed on Sep. 19, 2017.

(51) Int. Cl.

| | |
|---|---|
| ***A47G 27/04*** | (2006.01) |
| ***A47C 31/06*** | (2006.01) |
| ***E04F 11/17*** | (2006.01) |
| *A44B 17/00* | (2006.01) |
| *E04F 11/02* | (2006.01) |
| *E04G 21/30* | (2006.01) |

(52) U.S. Cl.

CPC ..... *A47G 27/0418* (2013.01); *A47C 31/06* (2013.01); *E04F 11/175* (2013.01); *A44B 17/0041* (2013.01); *E04F 2011/0203* (2013.01); *E04G 21/30* (2013.01); *Y10T 428/24008* (2015.01); *Y10T 428/24017* (2015.01)

(58) Field of Classification Search

CPC ..... Y10T 428/24008; Y10T 428/24017; Y10T 16/118; Y10T 16/131; A47G 27/0418; A47G 27/0425; A44B 17/00–0094

See application file for complete search history.

(56) References Cited

U.S. PATENT DOCUMENTS 1,782,293 A * 11/1930 Elliott ..... A47G 27/0418 16/4

2005/0155178 A1* 7/2005 Prest ..... A47G 27/0287 16/8

* cited by examiner

*Primary Examiner* — Alexander S Thomas

(74) *Attorney, Agent, or Firm* — Bycer Law, PLC; Matthew L. Bycer

(57) ABSTRACT

A rug mounting system and method includes an elongate fastening driven into a flooring surface. The elongate fastener is coupled with a fastening area and a complementary fastener. The underside of the rug is fitted with a complementary fastening area and fastener. A flat item that includes the fastening area is affixed to the flooring surface, and the elongate fastener is applied to the flooring surface therethrough, thus exposing the lower end fasteners. The rug is then placed over both fastening types and mounted on the ground. One, or more, mounting systems may be used to secure a rug to the ground.

18 Claims, 5 Drawing Sheets

RUG MOUNTING SYSTEMS AND METHOD

CROSS REFERENCE TO RELATED APPLICATION

The present application includes subject matter disclosed in and claims priority to prior filed U.S. Provisional Patent Application Ser. No. 62/560,468, filed Sep. 19, 2017, entitled "ADVANCED RUG SYSTEMS", incorporated herein by reference and describing an invention made by the present inventor.

BACKGROUND OF THE INVENTION

1. Field of the Invention

The present invention relates to display rug, and more particularly to mounting systems for display rugs.

2. Description of Related Prior Art

Rugs are used and placed on a flooring surface to provide additional appeal, footing, or accent. Many of these rugs are applied as throw rugs, whereby they are simply placed onto the flooring surface. Many rugs include a high friction lower surface (e.g. rubberized, spikes, etc.) to catch the floor so as to prevent slipping. Unfortunately, slipping, wind, or other forces act laterally to move the rug after it is positioned. Further, when placed outdoors, or on a soil surface, high friction surfaces do not always work.

Others have used stakes to stake the rug into the ground. This often leads to ruination of the rug, or may be made through pre-made holes. However, such a method is a more permanent affixing of the rug to the flooring surface. When the rug needs to be moved, cleaned, or otherwise serviced, replacing the rug to the same location may be difficult.

It is therefore a primary object of the present invention to provide a rug mounting system that can use both mostly-permanent fixture in the ground/floor with a semi-permanent/temporary fixture of the rug to the ground mount.

Another object of the present invention is to provide a flooring mount with complementary fastening means to a lower surface of a rug.

These and other objects of the present invention will become apparent to those skilled in the art as the description thereof proceeds.

SUMMARY OF THE INVENTION

The present invention is directed to a removably mounted rug for mounting onto a flooring or ground surface. The rug top surface will be exposed to the user, while the mounting system may be hidden. The rug includes a lower surface applied over the floor. The lower surface may contain an exposed fastening area or strip, such as a hook-and-loop fastener, or as otherwise be known in the art, and a nearby partial fastener (such as a female snap fastener). Each of the partial fastener and fastening area will mate with complementary fasteners that are coupled with an elongate fastener (e.g. screw, stake, nail, etc.) that can be driven into the flooring surface. The elongate fastener either includes a complementary (snap) fastener or is coupled to one. A strip of fastening material, complementary with fastening strip on lower surface of rug, is coupled to the elongate fastener, and is preferably on a disc or strip that is pierced or passed through by elongate fastener. The disc or strip may include an upper surface adapted to engage lower surface of rug. The disc or strip may also include a lower surface adhesive, or other means to permanently affix to the floor.

The present invention also includes a method of applying and mounting a rug onto a flooring surface. The flat material (having a top surface with complementary fastening strip) is placed along the flooring surface. The flat material may be adhered to the flooring surface. The elongate fastener is posted or drilled through the flat material (preferably through a premade aperture) and into the flooring surface, thereby fixing the location of the flat material relative a point on the flooring surface. The rug is then applied, whereby the rug lower surface is affixed to the posted pieces, and complementary fastener and strip are applied to one another. The rug may then be disengaged by disengaging both the fastener (snap) and the fastening are (hook-and-loop), and removed.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

Figure 1:
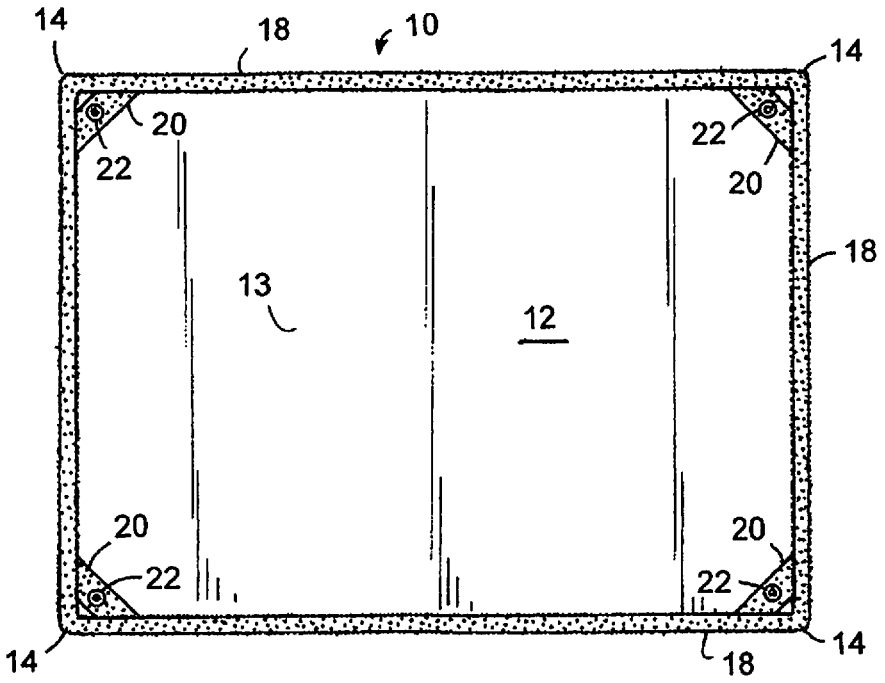
FIG. 1 illustrates a bottom view of a rug of an embodiment of the present invention.
Figure 1A:
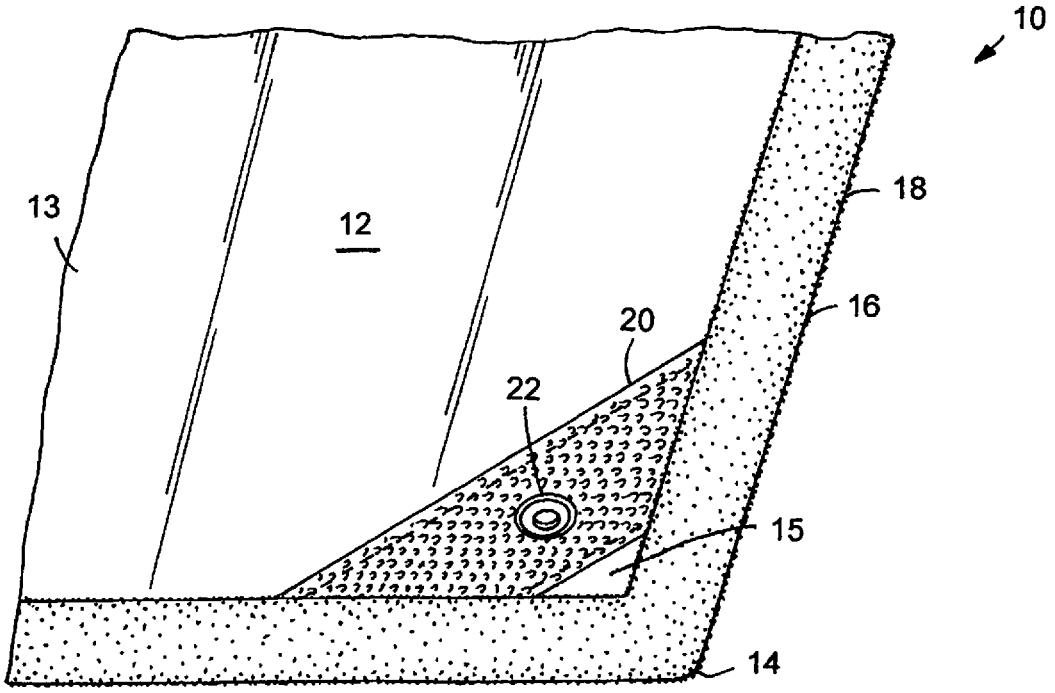
FIG. 1A illustrates a bottom view of a partial corner of a rug of an embodiment of the present invention.

The present invention is directed to a rug or carpet, or otherwise a throw rug, that may be placed upon and/or affixed to any flat surface. While the embodiments shown herein describe a rectangular rug with 90 degree right corners, the present invention shall not be read to be limited to such shaped rugs, and may be used in a variety of shaped rugs that include at least one end or edge that may be accessed when applying to a ground or floor surface. The present invention may be distinguished from carpets which are otherwise tacked or affixed end-to-end in a specific space, and cannot be affixed in a manner such as shown below. The present invention is directed primarily to overcome issues with rugs that are otherwise typically unanchored and may slip, slide, twist, spin, or otherwise move when placed in position.

The rug of the present invention may be constructed or otherwise made in such a fashion as to allow for a variety of anchoring or affixing systems to hold it in place. Preferably, rug 10 includes a top surface 11 as is known in the art for rugs which may be of a variety of forms. The lower surface 13 of the rug may include backing 12, such as a rubber backing, or otherwise known in the art. In the present embodiment, the rug includes corner 14. Corner 14 is enhanced with a fastening strip 20 on lower surface 13, preferably at 45 degree angle from each of edges 18. Fastening strip, or fastening areas as described herein are preferably hook-and-loop fasteners as are known in the art, preferably with the hook side along the rug, but may include any type of temporary fasteners as are known in the art. A trim 16 is provided along edges 18, in this case shown to be folded over from top surface 11. Any edge or trim may work in the present invention, including an exposed naked edge. However, it is preferable to have a trim that can cover at least a portion of the edges of the rug so that portions of the present fastening strip are not otherwise exposed, felt, or shown when rug is set in place. Fastening strip 20 crosses between two edges along a corner 14 and may fill the entire corner, up to the edge of the trim 16, or may include an exposed corner space 15 whereby backing 12 is exposed between a fastening strip 20 and an edge 18 and/or trim 16.

Fastening strip 20 along corner 14 is preferably a hook-and-loop type fastener that exposes the hooks to the underside of the rug, to allow for affixing to a complementary loop fastener (as will be explained below). Fastening strip 20 is preferably stitched and/or glued onto backing 12. It is preferable that the backing is both stitched and glued to fastening strip so as to permanently affix fastening strip to backing. Alternatively, fastening strip may replace backing of rug and expose directly to the underside of a top surface 11 (not shown). Female snap fastener 22 may be embedded within fastening strip 20. Preferably female fastening strip is aligned along the corner, equidistance from either edge 18. Female snap fastener 22 is preferably affixed via glue and/or other fastening method known in the art directly to backing, or rug as described above. Female snap fastener sits within fastening strip, and may fit in a small aperture made into the fastening strip so as to directly contact with backing. Otherwise, female snap fastener may be integral with backing, integral with fastening strip, or otherwise. The main point of female snap fastener is that it is permanently affixed in location relative rug corner 14. Female or male fastener may be used along the rug to complement another feature (described below). Snap fasteners may be used, or any type of point fasteners as are known in the art.

In one embodiment of the present invention, rug 10 may be affixed to a solid flat and/or smooth surface. For instance, were the rug preferred to be positioned onto a wooden plank, deck, or other surface, a disc and screw method is preferred. Disc 30 is preferably first applied to the surface in location where the rug is set to be placed. In some methods, screw 40 may first be applied onto ground surface to create pilot hole, and then unscrewed in order to apply disc 30. Disc includes disc bottom 34 which is preferably adhered to the ground surface. Common methods of adhering the disc to the ground surface include adhesive, tape, or otherwise glue as is known in the art. Once disc 30 is applied to the ground surface, disc top 32 is exposed for fastening to rug. Disc top preferably includes loop fastening for hook-and-loop mating with fastening strip in rug, or any complementary fastening area as is known in the art. Screw 40 includes specialized hardware to affix to both ground surface via threads 46 which may be driven via screw head 42 which may include recessed Phillips head 43 therewithin. Male fastener 44 includes a circumferential extending rim that is shaped for complementary mating with female snap fastener. Once disc is applied to ground surface, screw may be permanently affixed into ground surface exposing only the top surface including screw head 42 with male fastener 44. Rug is then positioned over disc 30 and screw head 42 whereby snap fasteners are mated and hook-and-loop fasteners are mated. One or more corners may be mounted in such a way onto the ground as in all embodiments of this invention. In the preferred embodiment, at least one, but preferably at least three mounting locations are applied per rug. In the rectangular embodiments of the present invention, it is preferred that all four corners of such rectangle are affixed to the ground surface. The use of a singular post (described above as a screw and snap fastener) in combination with a hook-and-loop fastener prevents the rug from twisting or sliding when positioned around a single mounted location. The hook-and-loop fastener provides for reinforced holding against a ground surface.

In an alternative embodiment of the present invention, a similar rug may be fashioned and fastened to ground via strip 50. Strip 50 preferably includes complementary features to rug under surface so as to allow affixing to a ground surface. In this embodiment, a stake 60, such as a male post, or otherwise known in the art, is used on a softer ground surface, such as in soil or otherwise as may be understood by one having ordinary skill in the art. Strip includes male snap fastener 52 along a top 51 embedded within a hook-and-loop region 54. It is preferred that the male snap fastener and fastening region of the strip is offset in such a way as to provide for multiple application arrangements.

In a first arrangement, the post will be affixed outside the perimeter of rug edge 18. In this way, strip is first affixed to underside of rug via male snap fastener and hook-and-loop region to complementary features in rug. Long end 58 extends beyond edge 18 so as to expose long aperture 59 outside the perimeter of the rug. In this manner, the rug may be placed down onto a surface and the stake (preferably with washer 62) is applied into the ground surface. One drawback of this method of posting to the ground includes the issue of the stake head 64 and washer, including a portion of strip 50, being exposed around rug as a tripping hazard, unsightly view, etc.

An alternative arrangement for placing strip onto ground surface for mounting of rug includes hiding short end under rug. Strip is rotated 180 degrees so that long end is directed towards center of rug, while short end is directed toward corner. As can be seen, short end 56 is hidden within perimeter of rug 10. Similarly, snap fasteners and hook-and-loop fasteners will be mated. One advantage of including a trim 16 in rug 10 is that the features of exposed stake and washer can be better hidden under corner of rug. It is preferred that the entire fastening means will be hidden when applied. In order to apply fastener, strip 50 is first applied to the ground surface and a stake 60 is applied through washer 62 and strip short end aperture 57 into ground surface. Rug may then be applied over fastener including complementary mating of snap fastener and hook-and-loop fastener. When applied, the entire fastening means is hidden and the rug is fixed in place.

One advantage of the present invention is that while the mounting to the ground of the stake and/or screw, etc. may be a permanent fixture, the rug may be released of hook-and-loop fasteners and snap fasteners so as to allow cleaning removal replacement, or otherwise, treatment of rug without affecting ground mounts. Ground mounts may be set in place, and rug may be pulled up and used for an alternative venue, and returned to the present location without having to fasten once more into ground.

Referring now to FIG. 1, rug 10 is shown from the bottom wherein lower surface 13 is shown. The present invention may work with numerous types of rugs or other flat bodies, or bodies with a flat surface, including rugs with backing 12. Rug includes corners 14, edge 18, and trim 16. Edges 18 define the circumference of the rug, while trim is provided whereby the upper surface (an optionally rug surface feature) are exposed to the bottom of the rug. This reinforced trim edge provides for strength and prevents fraying of rug. A mounting location is placed along corners 14. A diagonal, or otherwise placed area of fastening is provided in fastening strip 20. Female snap fastener 22 is preferably embedded within fastening strip 20.

Figure 2:
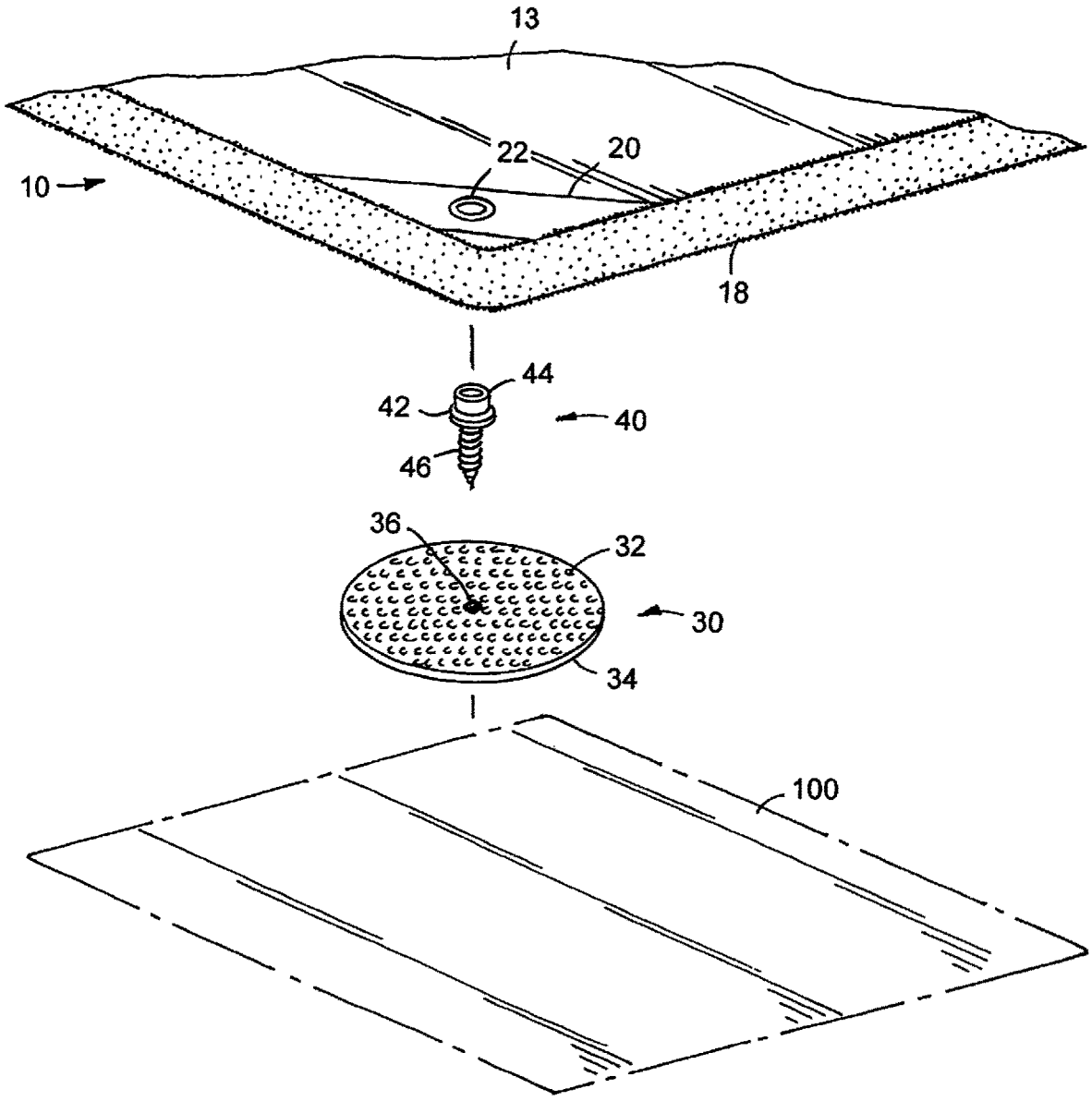
FIG. 2 illustrates an exploded view of a bottom of a partial corner of a rug over fastening and a flooring surface.

Referring now to FIG. 2, an exploded perspective version of the rug bottom and flooring is shown. The view indicates the rug and flooring surface as though viewed from between the two objects in art perspective. Rug 10 is shown with lower surface 13 exposed to flooring 100. In this embodiment, flooring is perceived to be a wooden plank floor, such as an outdoor deck, or indoor flooring surface. Fastening strip 20 includes female snap fastener 22. Alternatively, rug may include a male snap fastener while screw or other mounting device may include the female portion of such fastener. Rug edge fits over and covers all features of the fastening screw 40 and disc 30. Screw 40 includes threads 46 and screw head 42. Screw head 42 includes male snap fastener 44 adapted to mate with female snap fastener 22. Disc 30 includes a top surface 32 shown with complementary hook-and-loop fasteners for mating with fastening strip 20. Disc 30 also includes an aperture 36 which may be prepunched or otherwise punched when mounting screw into flooring surface. The lower end 34 of disc 30 may include some kind of adhesive to stick to the ground. When mounting this embodiment, it is preferred that the disc is first placed on the ground, then the screw is drawn through the center of the disc, exposing both the hook-and-loop fastener of the disc and the screw head with complementary fastener above, and then the rug is placed thereover mounting both on the snap fastener and hook-and-loop fasteners of the screw and disc, respectively.

Figure 3:
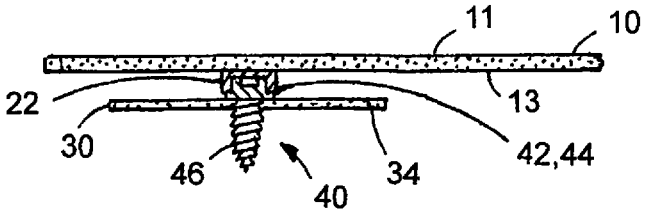
FIG. 3 illustrates a cross-sectional side view of a rug with fastening device of an embodiment of the present invention.
Figure 4:
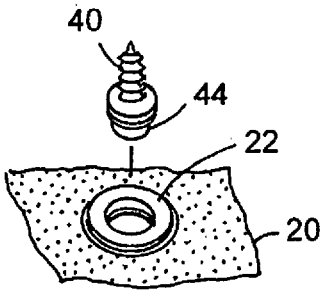
FIG. 4 illustrates a partial exploded bottom perspective view of combined fasteners of an embodiment of the present invention.
Figure 4A:
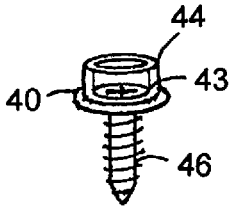
FIG. 4A illustrates a perspective view of an elongate fastener of an embodiment of the present invention.
Figure 5:
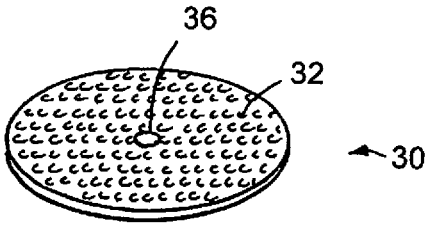
FIG. 5 illustrates a perspective view of a flat fastener of an embodiment of the present invention.

As shown in FIGS. 3 through 5, this embodiment is shown. FIG. 3 demonstrates a cross-sectional side view of the rug placed on top of the screw 40 and through disc 30. Threads 46 extend beyond disc 30. Disc bottom 34 includes potential adhesive. Female snap fastener 22 embedded within rug 10 mates with screw head 42 and erupting rim to form a male fastener end 44. Rug includes top surface 11 and bottom surface 13. As can be seen in FIG. 4A, screw includes embedded, or recessed, Phillips head 43 or otherwise features to allow for manual or driven screwing for placement into a flooring surface. FIG. 5 demonstrates disc with sensor aperture 36 and disc top 32 with hook-and-loop fastener.

Figure 6:
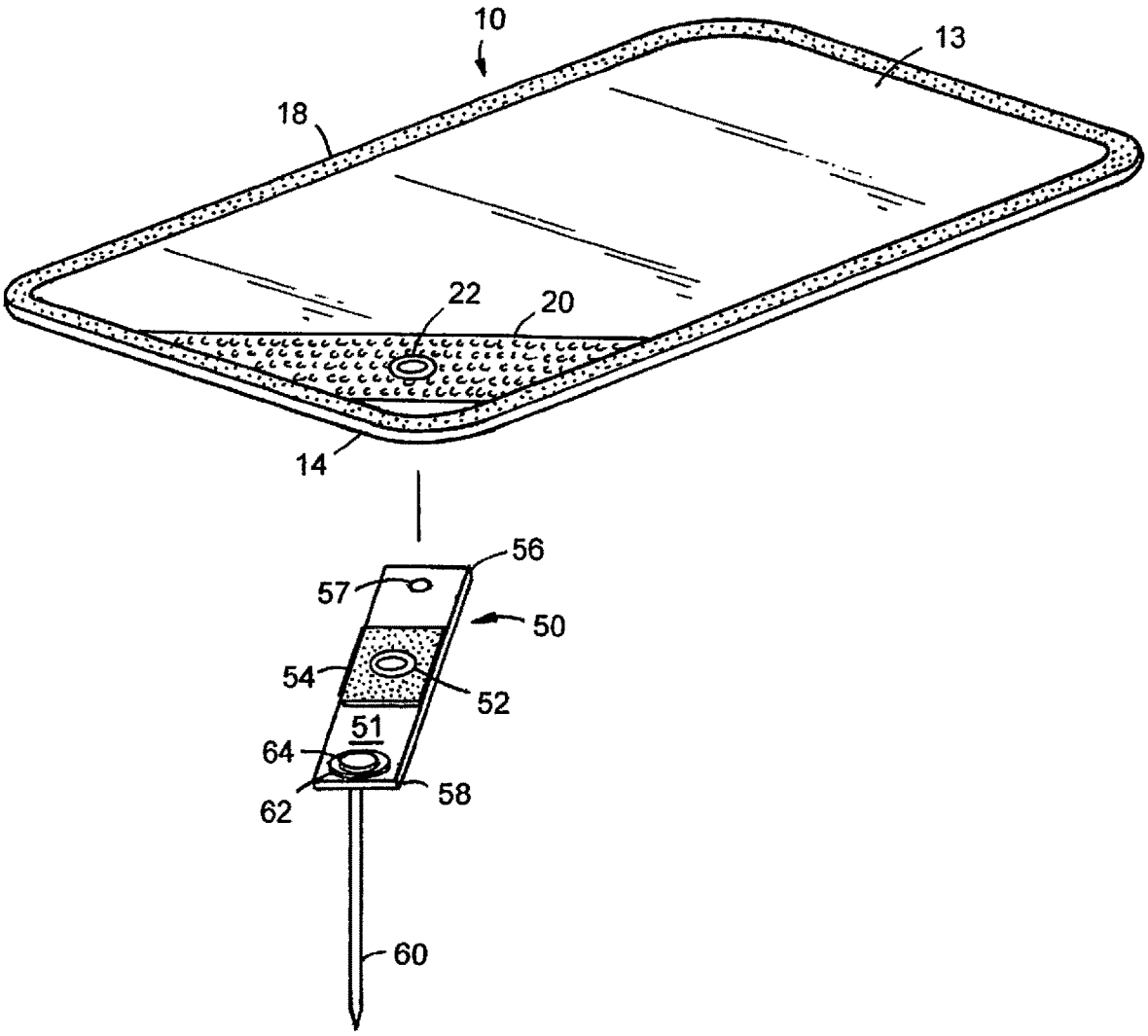
FIG. 6 illustrates a bottom perspective view of a rug of the present invention over the top perspective view of a fastener of the present invention.

Referring to an alternative embodiment shown in FIG. 6, the same perspective view is shown whereby the viewer is between the top of the anchor system and below the rug. Rug 10 includes lower surface 13 and edge 18. Rug further includes corner 14 with fastening strip nearby or otherwise close to corner, with embedded fastener 22. A strip 50 is provided with a short end 56, an aperture near short end 56 as shown as aperture 57. Furthermore, strip 50 includes male snap fastener 52, or otherwise a complementary fastener for rug fastener 22, and such fastener is preferably embedded in a fastening strip, or hook-and-loop region 54 to complement with fastening strip 20 on rug 10. Both fastening region 54 and complementary male snap fastener 52 are aligned along strip top 51. Additionally, a long end 58 is provided with an aperture (not shown). A stake 60 may be driven through aperture and held in place via washer 62 to hold head in place.

Figure 7:
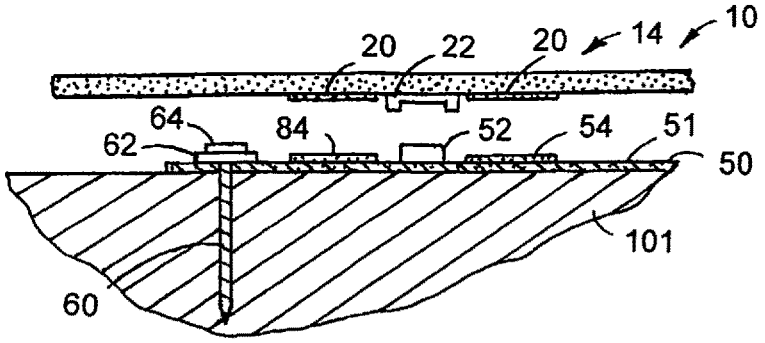
FIG. 7 illustrates a cross-sectional side view of a rug with fastening device of an embodiment of the present invention.

As can be seen in FIG. 7, a cross-sectional view of the present embodiment placed onto an alternative ground 101 such as a soil or dirt floor. Rug 10 includes corner 14 reinforced with fastening strip 20 and female snap fastener 22. Strip 50 includes hook-and-loop region 54 and male snap fastener 52 exposed to rug 10. Stake 60 is provided through strip 50 with washer 62 holding stake head 64 above ground. Both hook-and-loop fasteners of the rug and strip are to mate along with the snap fastener.

Figure 8:
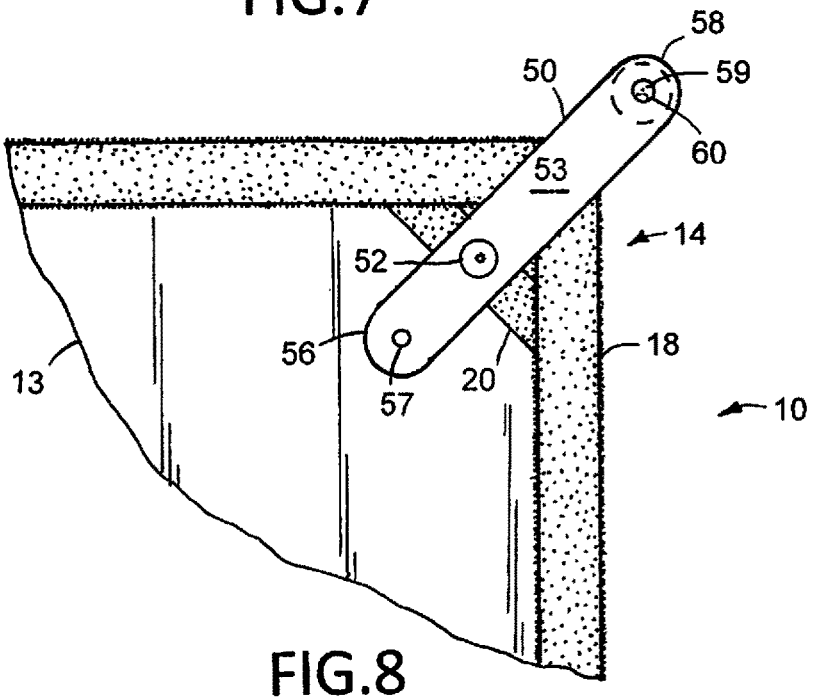
FIG. 8 illustrates a bottom view of a partial corner of a rug of an embodiment of the present invention.

Referring now to FIG. 8, the long end of strip is shown for staking outside of the circumference of the rug. The bottom view is shown. Rug 10 includes lower surface 13 and corner 14 along edge 18. Fastening strip 50 is provided with strip bottom 53 exposed towards the alternative ground surface. The lower end of the male snap fastener 52 is shown as it is riveted onto strip. Fastener may otherwise be attached to strip as is known in the art. Short end 56, along with short end aperture 57, is shown occluded by rug from views above. Long end 58 is exposed beyond the edge 18 and can be staked into ground via stake 60 through long end aperture 59.

Figure 9:
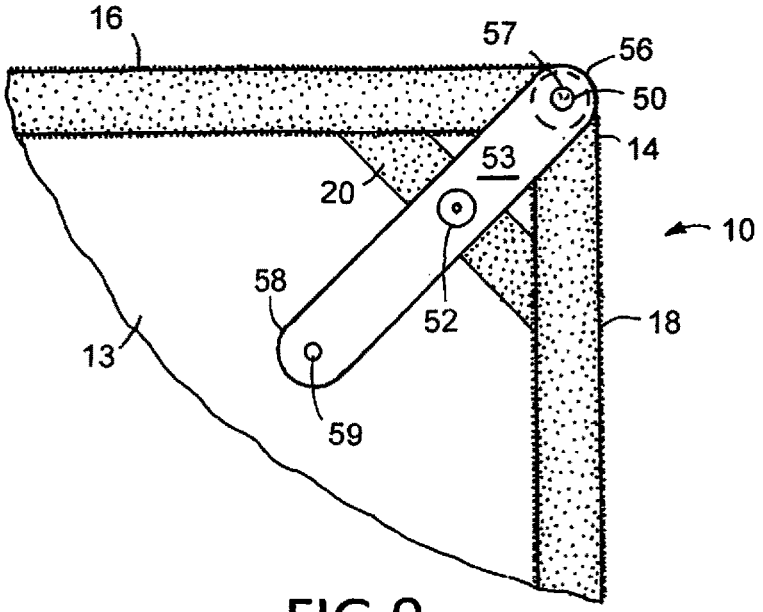
FIG. 9 illustrates a bottom view of a partial corner of a rug of an embodiment of the present invention.

Conversely, as shown in FIG. 9, the short end of the strip may be used so that the entirety of the strip is occluded from view from the top when applied to the ground. In this manner, one may fasten a rug to a position on the ground without any indication as to how it is anchored. Reinforced trim 16 on edge 18 further mask the thickness and bumps of the fastening strip and mounted stake. As can be seen, rug 10 includes exposed lower surface 13. Rug includes fastening strip 20 along corner 14. Strip 50 includes lower surface or strip bottom 53 and shows fastener 52. Long end 58 is shown further towards center of rug while short end 56 goes as far as or not as far as the edge of the rug. Stake 60 is driven into the ground through short end aperture 57 to mount rug to ground.

I claim:

1. A removably mounted rug mounted onto a flooring surface, said rug comprising:

(a) a flat material including a bottom surface, a top surface;

(b) a fastening strip on the bottom surface;

(c) a first partial upper fastener attached to the bottom surface, said first partial fastener in proximity to said fastening strip;

(d) an elongated fastener driven into the flooring surface and at least partially affixed within and below the flooring surface;

(e) a second partial lower fastener coupled to said elongated fastener, said second partial lower fastener adapted to complement and mate with said first partial upper fastener;

wherein said elongated fastener is further coupled to a second fastening strip, said elongated fastener set through an aperture in said second fastening strip, said second fastening strip adapted to complement and mate with said fastening strip.

2. A removably mounted rug as set forth in claim 1 wherein said second fastening strip comprises a top side adapted to complement and mate with said fastening strip, and a bottom side adapted to interact with said flooring surface.

3. A removably mounted rug as set forth in claim 2 wherein said second fastening strip bottom side comprises an adhesive to affix to the flooring surface.

4. A removably mounted rug as set forth in claim 2 wherein said fastening strip extends from a first edge of the rug to a second adjacent edge of the rug.

5. A removably mounted rug as set forth in claim 4 wherein said fastening strip defines an exposed corner space on the bottom surface whereby a backing is exposed as between said fastening strip, said first edge and said second adjacent edge.

6. A removably mounted rug as set forth in claim 4 wherein said fastening strip extends at a forty-five degree angle from said first edge to said second adjacent edge.

7. A removably mounted rug as set forth in claim 2 further comprising a fastening patch removably coupled to the fastening strip.

8. A removably mounted rug as set forth in claim 7 wherein said fastening patch comprises an aperture adapted to receive said elongated fastener.

9. A removably mounted rug as set forth in claim 2 wherein said partial lower fastener comprises a male coupler end of a snap fastener; and the partial upper fastener comprises a female coupler end of a snap fastener.

10. A removably mounted rug as set forth in claim 2 wherein said elongated fastener comprises a screw with a head comprising a male coupler end of a snap fastener.

11. A removably mounted rug as set forth in claim 2 wherein said second fastening strip comprises a male coupler end of a snap fastener along a top side of the second fastening strip.

12. A removably mounted rug as set forth in claim 2 wherein the elongated fastener is affixed to an aperture in the second fastening strip directly below a portion of the rug.

13. A removably mounted rug as set forth in claim 2 wherein said second fastening strip comprises said second partial lower fastener along an upper surface of said second fastening strip, and further comprises at least one aperture adapted to receive said elongated fastener therethrough.

14. A removably mounted rug as set forth in claim 13 wherein said second fastening strip comprises a short end and a long end on opposing ends relative said second partial lower fastener, said short end comprising a first aperture, and said long end comprising a second aperture.

15. A removably mounted rug as set forth in claim 14 wherein said elongated fastener is a stake driven into said flooring surface, and said elongated fastener is driven through said at least one aperture in said second fastening strip.

16. A removably mounted rug as set forth in claim 13 wherein said flat material covers said elongated fastener.

17. A removably mounted rug as set forth in claim 1 wherein said first partial fastener is set within said fastening strip.

18. A removably mounted rug as set forth in claim 17 wherein said elongated fastener is further coupled to a second fastening strip, said elongated fastener set through an aperture in said second fastening strip, said second fastening strip adapted to complement and mate with said fastening strip.

* * * * *